United States Patent [19]

Ikesue et al.

[11] 4,228,567

[45] Oct. 21, 1980

[54] BUCKLE ASSEMBLY FOR SEAT BELT

[75] Inventors: Haruyuki Ikesue, Fujisawa; Kazuo Yamamoto, Sagamihara, both of Japan

[73] Assignee: NSK-Warner K.K., Tokyo, Japan

[21] Appl. No.: 941,164

[22] Filed: Sep. 11, 1978

[30] Foreign Application Priority Data

Sep. 20, 1977 [JP] Japan ..... 52-126632[U]

[51] Int. Cl.[2] ..... A44B 11/26

[52] U.S. Cl. ..... 24/230 AL

[58] Field of Search ..... 24/230 AL

[56] References Cited

U.S. PATENT DOCUMENTS

| | | | |
|---|---|---|---|
| 3,522,640 | 8/1970 | Lohr | 24/230 AL |
| 3,555,632 | 1/1971 | Lindblad | 24/230 AL |
| 3,675,281 | 7/1972 | Stephenson | 24/230 AL |
| 3,704,633 | 12/1972 | Iverson | 24/230 AL |
| 3,770,919 | 11/1973 | Lewis | 24/230 AL UX |
| 3,795,030 | 3/1974 | Yates et al. | 24/230 AL |
| 3,955,056 | 5/1976 | Lindblad | 24/230 AL X |
| 4,004,115 | 1/1977 | Esner | 24/230 AL X |
| 4,025,992 | 5/1977 | Lindblad | 24/230 AL |
| 4,069,557 | 1/1978 | Loomba | 24/230 AL |
| 4,100,657 | 7/1978 | Minolla | 24/230 AL |
| 4,128,924 | 12/1978 | Happel et al. | 24/230 AL |

FOREIGN PATENT DOCUMENTS

| | | | |
|---|---|---|---|
| 2348532 | 4/1974 | Fed. Rep. of Germany | 24/230 AL |
| 2732401 | 1/1978 | Fed. Rep. of Germany | 24/230 AL |

*Primary Examiner*—Philip C. Kannan

*Attorney, Agent, or Firm*—Shapiro and Shapiro

[57] ABSTRACT

A buckle assembly for seat belt comprises cover means consisting of a first and a second cover member forming a tongue insertion opening and a hollow chamber connected to the opening. The first cover member has a push button operating opening connected to the hollow chamber. A latch means including a plurality of members is disposed within the cover means and capable of taking up two positions, i.e. tongue locking position and non-locking position. The members comprising the latch means are a base member having a tongue guide path contiguous to the tongue insertion opening and extending in the direction in which the tongue is to be inserted, the base member having guide means formed transversely of the direction in which the tongue is inserted, a latch member having a first portion and a second portion and slidably disposed in the guide means of the base member, the first portion adapted to contact the tongue when inserted and slide the latch member in the guide slot to permit insertion of the tongue, the second portion being for restraining the tongue in its locked position, and bias means disposed in the second cover member and biasing the latch member into its tongue locking position. In assembling the buckle assembly the members of the latch means are serially disposed in a half hollow chamber of the second cover in order to be assembled. A push button for operating the latch member is provided in the first cover member and engaged with the latch member.

5 Claims, 13 Drawing Figures

BUCKLE ASSEMBLY FOR SEAT BELT

BACKGROUND OF THE INVENTION

1. Field of the Invention

This invention relates to a buckle assembly for seat belt.

2. Description of the Prior Art

Numerous buckle assemblies for seat belt have heretofore been proposed and used. Any of these buckle assemblies comprises a tongue and a latch device for restraining the tongue, and the latch device usually consists of a base, a latch member biased toward tongue locking position, a push button for operating the latch member, and a cover surrounding and supporting all these members. In these buckle assemblies, the various members must be assembled properly in interlocking relationship between the base and the cover, and in the buckle assemblies of the prior art, each component has been complex in configuration and must be assemblied separately and manually because of its construction as well as its configuration, which has led to greater cost of manufacture and non-negligible irregularity of the end product.

SUMMARY OF THE INVENTION

It is therefore an object of the present invention to provide a buckle assembly for seat belt components which are simple in configuration and easy to be manufactured, assemblage of which can be effected in good order and which can be simply assembled manually and may also be manufactured automatically.

The object of this invention is attained by the buckle assembly of this invention in which the components may simply be arranged serially to complete a buckle assembly and which comprises cover means including a first and a second cover member forming a tongue insertion opening and a hollow chamber connected to said opening, said first cover member having a push button operating opening connected to said hollow chamber, latch means consisting of a plurality of members disposed within said cover means and capable of taking up two positions, i.e. tongue locking position and non-locking position, said members composing said latch means being a base member having a tongue guide path contiguous to said tongue insertion opening and extending in the direction in which the tongue is to be inserted, said base member having a guide slot formed transversely to the direction in which the tongue is inserted, a latch member having a first portion and a second portion and slidably disposed in the guide slot of said base member, the first portion adapted to contact the tongue when inserted and slide along said guide slot to permit insertion of the tongue, said second portion being for restraining the tongue in its locked position, and bias means disposed in said second cover member and biasing said latch member into its tongue locking position, and a push button for operating said latch member, said push button being provided in said first cover member and engaged with said latch member.

The invention will become more fully apparent from the following detailed description thereof taken in conjunction with the accompanying drawings.

DESCRIPTION OF THE PREFERRED EMBODIMENTS

Figure 1:
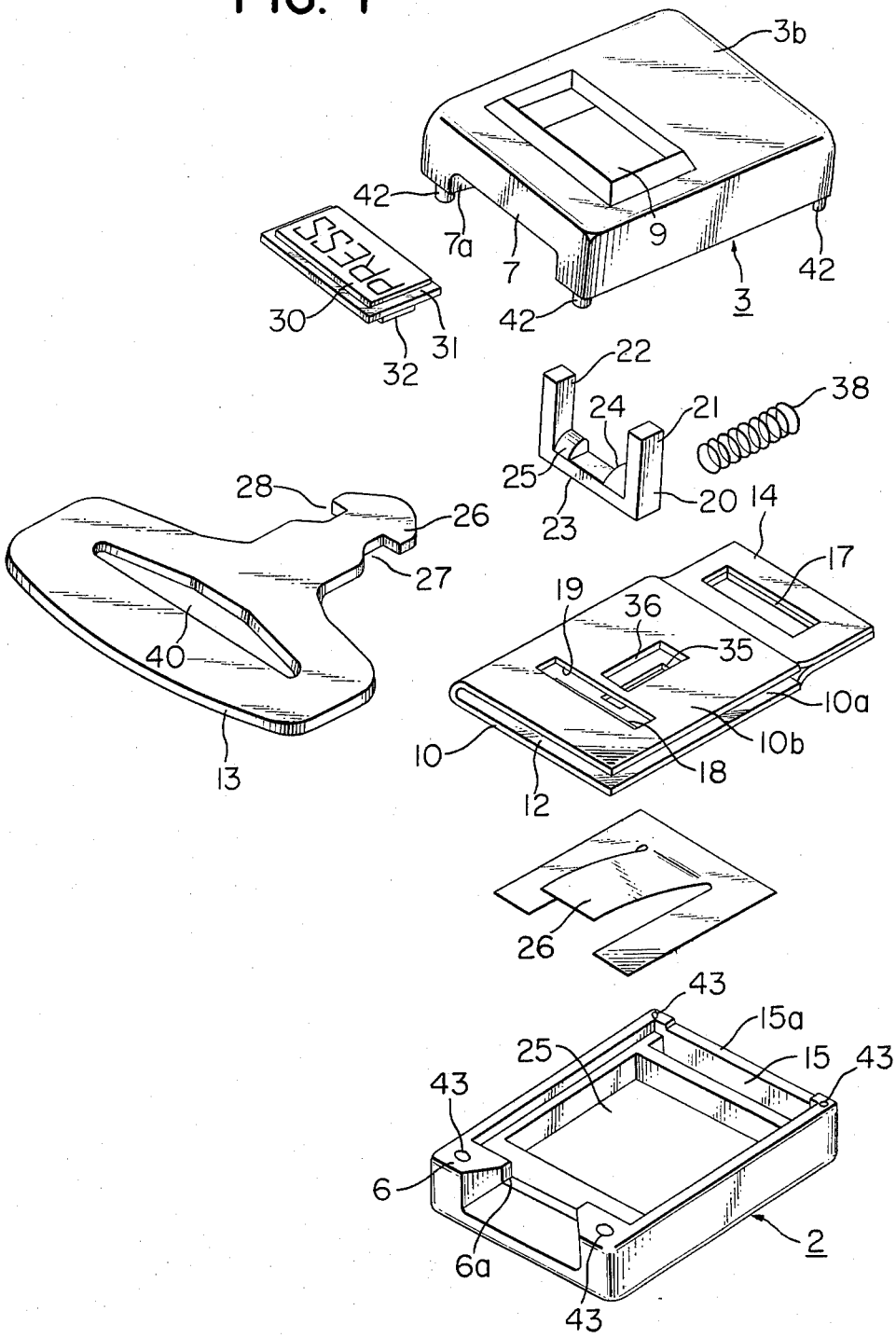
FIG. 1 is an exploded view of a first embodiment of the present invention.
Figure 2:
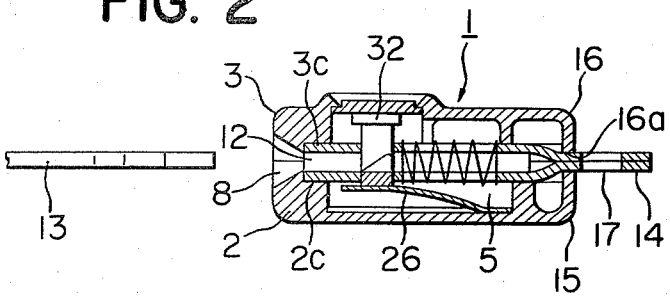
FIG. 2 is a longitudinal sectional view of the first embodiment showing a buckle device before a tongue is inserted.
Figure 3:
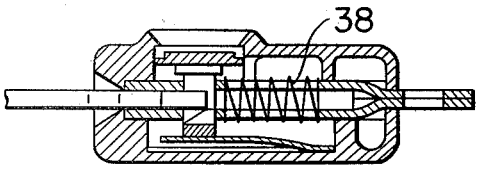
FIG. 3 shows the device as the tongue is inserted thereinto.

Referring to FIGS. 1 to 4, these show a first embodiment of the present invention.

In the drawings a latch device of a buckle assembly for seat belt is generally designated by a reference numeral 1. The latch device 1 has a substantially rectangular lower cover 2 and a substantially rectangular upper cover 3. These upper and lower covers 3 and 2 are combined together to form a box-like configuration having a chamber 5 formed therewithin. The front (in the drawing, the left) side walls 7 and 6 of the upper and lower covers 3 and 2 are formed with cut-away portions 7*a* and 6*a*, respectively, and these cut-away portions 7*a* and 6*a* together form a tongue insertion opening 8 (FIG. 2) connected to the interior chamber 5. The front portion of the upper wall 3*b* of the upper cover 3 is formed with a push button operating opening 9.

Within the upper and lower covers 3 and 2, there are formed horizontal stepped portions 3*c* and 2*c*, on which a base member 10 rests. The base member 10 comprises two parallel flat plates 10*a* and 10*b* formed by bending a sheet of metal. The parallel flat plates 10*a* and 10*b* define a tongue insertion clearance 12 therebetween. The base member 10 is so disposed that at the front end thereof the clearance 12 is contiguous to the tongue insertion opening 8 formed by the upper and lower covers 3 and 2, the clearance 12 being sufficiently sized to receive and guide a tongue 13. At the rear end of the base member 10, the upper and lower parallel flat plates 10*b* and 10*a* are overlapped in cotnact with each other, and the overlapped portion 14 is projected rearwardly through an opening formed by cut-away portions 15*a* and 16*a* provided in the junctions of the rear walls 15 and 16 of the lower and upper covers 2 and 3, and the projected portion of the overlapped portion 14 is formed with an opening 17 for connecting thereto a webbing (not shown).

In the portions of the parallel flat plates 10*b* and 10*a* of the base member 10 which are below the push button operating opening 9 of the upper cover 3, latch member guide holees 18 and 19 are formed in opposed relationship with each other and vertically slidable latch member 20 is inserted in those guide holes. The latch member 20 is of a U-shape having vertically extending sides 21 and 22 and a connecting portion 23 interconnecting the lower portions of the sides 21 and 22. Disposed on the bottom wall of the lower cover 2 is an upwardly biasing plate spring 26 which upwardly biases the latch member 20 by contacting the connecting portion 23 of the latch member 20.

Figure 10:
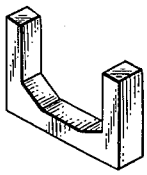
FIG. 10 is a perspective view showing a modified example of the latch member.

On the connecting portion 23 of the latch member 20, there are formed latch portions 24 and 25 contiguous to the sides 21, 22 of the latch member 20 and upwardly projected. Both the latch portions 24 and 25 have forwardly inclined cam portions and rearward vertical restraining portions so that the forwardly inclined cam portions first contact the end 26 of the tongue 13 and are downwardly forced thereby when the tongue is inserted through the tongue insertion opening 8 between the parallel flat plates 10*a* and 10*b* to thereby permit the insertion of the tongue 13, and when the tongue end 26 passes the latch portions 24 and 25 and cut-away portions 27 and 28 of the tongue 13 come to vertically overlap the latch portions 24 and 25, the latch member 20 is upwardly slid by a plate spring 26 and the tongue 13 is locked by the rearward vertical restraining portions of the latch member 20. Thus, the width of the tongue end is narrower than the spacing between the opposite sides 21 and 22 of the latch member 20, and the width of the portion having the cut-away portions 27 and 28 is narrower than the spacing between the latch portions 24 and 25. The latch member 20 may also be formed as shown in FIG. 10.

A push button 30 has a portion for receiving the opposite sides 21 and 22 of the latch member 20 formed in the lower portion thereof, and the push button 30 is disposed on the latch member 20 so that the opposite sides 21 and 22 are received in the receiving portion of the push button. The push button 30 has an edge portion 31 larger than the opening 9 of the upper cover 3, and thus, the push button is normally biased upwardly by the plate spring 26 so that the edge portion 31 contacts the rim of the opening 9. To ensure the operation of the push button 30, a guide wall (FIGS. 2 to 4) is desirably formed on the rim of the opening 9 of the upper cover 3 in the sliding direction of the push button.

Opposed slots 35 and 36 are formed centrally and lengthwisely in the parallel flat plates 10*a* and 10*b* of the base member 10, and a coil spring 38 is disposed between the parallel flat plates 10*a* and 10*b* being supported by slots 35 and 36. The coil spring 38 is compressed by abutting the end face of the tongue end 26 when the tongue 13 is inserted toward its locked position, and it forces out the tongue 13 by the bias force thereof when the tongue is released from the latch member 20.

The tongue 13 has the end portion as described previously, and an enlarged rear portion which is formed with an opening 40 for connection to the webbing.

Figure 4:
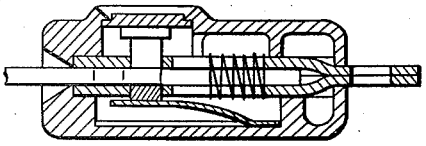
FIG. 4 shows the device as the tongue is locked.

With the above-described construction, when the tongue 13 is not inserted, the latch member 20 and the push button 30 are raised by the spring 26 and the latch portions 24 and 25 are located between the parallel plates 10*a* and 10*b* of the base member. On the other hand, the coil spring 38 is stretched along the full length of the guide slots 35 and 36 of the parallel plates 10*a* and 10*b* (see FIG. 2). When the tongue is inserted through the tongue insertion opening 8 (FIG. 3), the sloped portion of the latch portions 24 and 25 of the latch member 20 first abut the end 26 of the tongue 13 to lower the latch member. When the tongue is inserted until the cut-away portions 27 and 28 of the tongue vertically overlap the latch member, the latch member 20 is returned to its original position by the action of the plate spring 26 to lock the tongue 13 (FIG. 4). Since the coil spring 38 is compressed when the tongue is inserted, it biases the tongue outwardly while the tongue is in is locked position, and accordingly the tongue is locked by the latch member without backlash.

When the push button 31 is depressed downwardly, the latch member 20 is lowered so that the tongue is released from its locked position by the latch portions 24 and 25, and thus, the tongue 13 is pushed out by the action of the coil spring 38.

As is apparent from the foregoing, the tongue 13, the latch member 20 and the base member 10 are the components on which the load of the webbing directly acts and therefore, in the present invention, only these three components may be formed of a metal or like material which withstands the load of the webbing and the upper and lower covers 2 and 3 may be formed of light and inexpensive material such as resin.

The base member 10 can be easily manufactured by punching a single sheet into a desired shape and then bending the punched material, and can withstand a great load because two upper and lower 10*a* and 10*b* plates shares the load. Moreover, the tongue is guided and positioned by the two upper and lower plates and therefore play or backlash would not be brought about if the clearance between the parallel plates 10*a* and 10*b* and the thickness of the tongue are selected appropriately.

Description will now be made of the sequence of assembly of the present embodiment. First, the plate spring 26 is placed on the bottom wall 25 of the lower cover 2. Next, the base member 10 comprising the parallel plates 10*a* and 10*b* is disposed in place on the lower cover 2. Subsequently, the latch member 20 is inserted from above the opposed holes 18 and 19 of the parallel plates 10*a* and 10*b*. The coil spring 38 may be inserted through the slot 36 into a predetermined position after or before the placement of the latch member 20, or the base member with the coil spring 38 set to a predetermined position in the slots 35 and 36 between the parallel plates 10*a* and 10*b* may be disposed in place on the lower cover 2. Thereafter, the push button 30 is placed on the opposite sides 21 and 22 of the latch member 20, and by covering the button 30 with the upper cover 3 from thereabove and pushing the same downwardly, projections 42 provided on the lower portion of the side wall of the upper cover 3 are forced into apertures 43 formed in the portion of the lower cover 2 which is opposed to the projections 42 to secure the upper and lower covers 3 and 2 together, thus completing the assembly. The securing together of the upper and lower covers 3 and 2 may be accomplished not only by the forcing but also by any other securing method.

According to the present embodiment, assembly can be accomplished simply by placing the components in the predetermined positions from bottom to top and is very simple as a manual assembly work, and in addition, the simple configuration of each component reduces the operational error after assembly. Further, such assembly work is quite suited for being automated.

Figure 11:
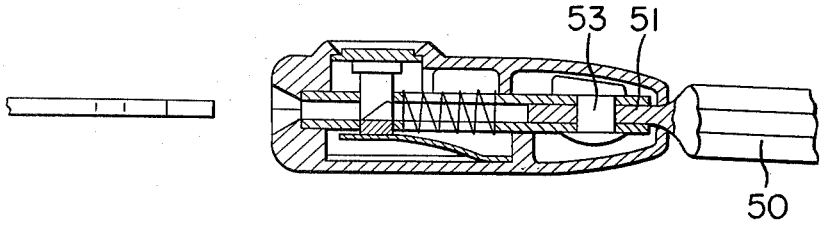
FIGS. 11 to 13 are longitudinal sectional views of a first, a second and a third modification of the first embodiment, respectively.
Figure 12:
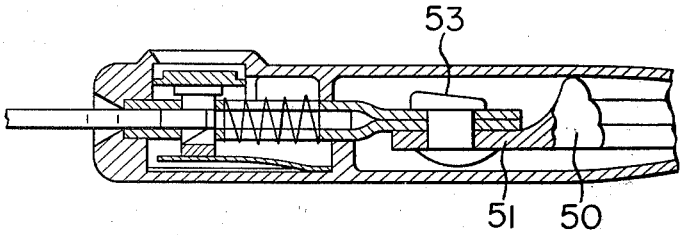
Figure 13:
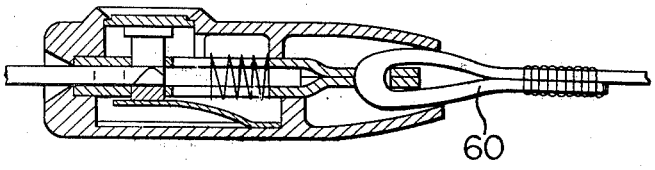

FIGS. 11, 12 and 13 show a first, a second and a third modification of the above-described first embodiment. In the first modification of FIG. 11, a flat end portion 51 of a connector 50 of the flexible wire assembly attached to the vehicle body is inserted between the parallel plates 10*a* and 10*b* and connected to the base member 10 by a rivet 53. The upper and lower covers 3 and 2 are designed to cover the connector portion also. Again in the second modification of FIG. 12, the rear end portion of the base member 10 is connected to the connector of the flexible wire assembly and attached to the vehicle body, and the upper and lower covers are elongated rearwardly to serve as the cover for the flexible wire assembly. In the case of the third modification of FIG. 13, a strand 60 itself of the flexible wire assembly is bent in a loop form and connected to the base member.

Figure 5:
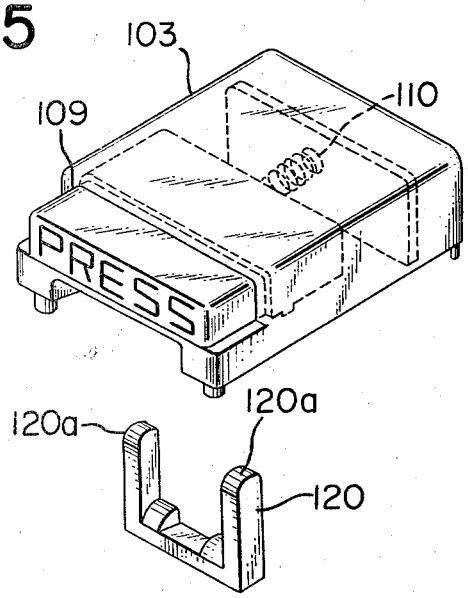
FIG. 5 is a perspective view showing an upper cover and a latch member of a second embodiment of the present invention.
Figure 6:
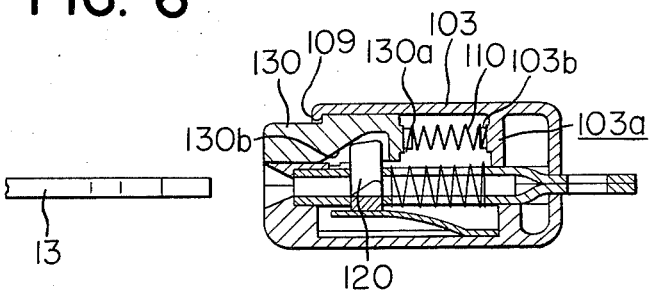
FIGS. 6 to 9 are longitudinal sectional views of the second embodiment, FIG. 6 showing the device before the tongue is inserted, FIG. 7 showing the device as the tongue is inserted, FIG. 8 showing the device when the tongue is in its locked condition, and FIG. 9 showing the tongue as it is released.
Figure 7:
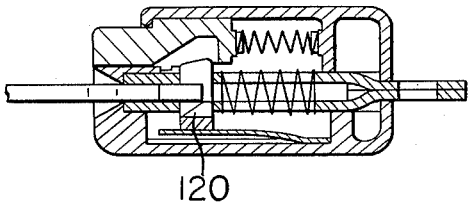
Figure 8:
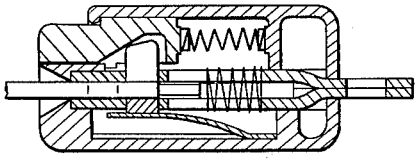

FIG. 5 is a perspective view showing only the modified portion of a second embodiment of the present invention, and FIGS. 6 to 8 are longitudinal sectional views of this embodiment and showing the operation steps.

As shown in FIG. 5, the second embodiment differs from the first embodiment in that a push button 130 is made as a slide type one. The ensuing description is directed to the difference and the parts similar to those in the first embodiment are given similar reference characters.

In the second embodiment, an upper cover 103 has a stepped portion at the left side thereof and the stepped portion has an opening 109 for operating the slide type push button 130. The slide type push button 130 has a protrusion outwardly extending from the opening 109, and the central portion thereof has a stepped portion so as to engage with an inwardly projected portion projected from the cover in the opening 109. The right end of the push button 130 is formed with a projection **130*a*, and the push button 130 is biased leftwardly by a coil spring 110 disposed between the projection 130*a* and a projection 103*b* formed on the inner wall 103*a* of the upper cover 103**.

The lower portion of the push button 130 engaged with a latch member 120 is formed with a recess having a cam surface **130*b* for lowering the latch member 120 when the push button is depressed, and the push button 130 has the cam surface 130*b* always engaged with the latch member 120. The upper surface of the opposite sides of the latch member 120 may preferably be somewhat sloped or rounded as shown at 120*a***.

The other construction of the second embodiment is identical to that of the first embodiment and need not be described, but operation will hereinafter be described.

When the tongue 13 is inserted, as shown in FIG. 7, the end of the tongue lowers the latch member 120 which thus locks the tongue as shown in FIG. 8, as in the first embodiment.

Figure 9:
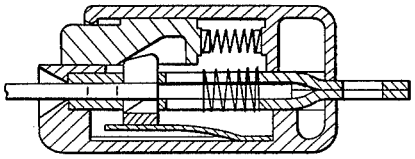

When the push button 130 is manually pushed rightwardly as shown in FIG. 9, the latch member 120 is lowered by the cam surface **120*a* so that the tongue is released from its locked condition in the manner as described in connection with the first embodiment, and the tongue jumps out leftwardly due to the bias of the coil spring 38**.

In the manufacture of the second embodiment, the push button 130 is first incorporated into the upper cover 130 with the coil spring 110, whereafter it is set in place on the lower cover 2.

According to the second emodiment, the slide type buckle assembly can be assembled with greater ease.

From the foregoing description it should be apparent that a precise buckle assembly can be manually or automatically assembled simply by arranging the components in order from bottom to top.

It is to be understood that the buckle assembly herein disclosed and described is presented for the purpose of explanation and illustration and is not intended to indicate limits of the invention the scope of which is defined by the following claims.

What is claimed is:

1. A buckle assembly for a vehicle seat belt comprising first and second opposing cover members defining a tongue insertion opening and a chamber therebetween communicating with the tongue insertion opening, a base member disposed within the chamber, the base member folded into a substantially U-shape to provide a pair of parallel plates defining a tongue guide path therebetween contiguous with the tongue insertion opening and extending in a tongue insertion direction, the fold connecting the parallel plates extending parallel to the tongue insertion direction, a portion of the parallel plates opposite to the tongue insertion opening being overlapped and in contact to provide a connecting portion adapted for connecting the buckle assembly to a vehicle body, the parallel plates having opposing guide slots extending transversely to the tongue insertion direction, a latch member slidably disposed within the guide slots, the latch member having a contacting portion for contacting a tongue inserted into the tongue guide path and for causing the latch member to slide to a non-locking position, the latch member having a restraining portion engageable with the tongue for locking the tongue, biasing means within the chamber for biasing the latch means toward a tongue locking position, and a push button for operating the latch member to move it to a non-locking position, the biasing means, latch member, and base member being serially disposed, in order, within the second cover member and the push button being disposed within the first cover member.

2. The assembly of claim 1, wherein the parallel plates have opposing supporting slots parallel to the tongue insertion direction for supporting a biasing member within the tongue guide path for biasing a tongue inserted into the tongue guide path outwardly toward the tongue insertion opening.

3. The assembly of claim 1, wherein the latch member is U-shaped and the contacting portion includes a forwardly inclined cam surface for moving the latch member to the non-locking position, and the restraining portion includes a surface engageable with a notch in the tongue to restrain the tongue from movement out of a buckle assembly.

4. A buckle assembly according to claim 1, wherein said push button is provided in said first cover member for movement in the direction in which said latch member slides.

5. A buckle assembly according to claim 1, wherein said push button is mounted on said first cover member for sliding movement in the tongue insertion direction, and has a surface engaging said latch member such that said latch member slides within the guide slots of said base member when said push button is operated.

* * * * *